US011807513B2

(12) United States Patent
Ray et al.

(10) Patent No.: US 11,807,513 B2
(45) **Date of Patent: *Nov. 7, 2023**

(54) APPARATUS, SYSTEM AND METHOD FOR MIXING LIQUID IN A BEVERAGE CONTAINER

(71) Applicant: CRAFT STANDARD ENTERPRISES, INC., Fayetteville, AR (US)

(72) Inventors: William Ray, Fayetteville, AR (US); Don Ray, Fayetteville, AR (US); Benjamin Simon, Dallas, TX (US)

(73) Assignee: CRAFT STANDARD ENTERPRISES, INC., Fayetteville, AR (US)

( * ) Notice: Subject to any disclaimer, the term of this patent is extended or adjusted under 35 U.S.C. 154(b) by 58 days.

This patent is subject to a terminal disclaimer.

(21) Appl. No.: 17/453,440

(22) Filed: Nov. 3, 2021

(65) Prior Publication Data

US 2023/0137829 A1 May 4, 2023

(51) Int. Cl.
*B67D 3/04* (2006.01)
*B67D 3/00* (2006.01)

(52) U.S. Cl.
CPC ..... *B67D 3/046* (2013.01); *B67D 3/0012* (2013.01)

(58) Field of Classification Search
CPC ..... B67D 3/046; B67D 3/0012
See application file for complete search history.

(56) References Cited

U.S. PATENT DOCUMENTS 3,231,154 A 1/1966 Johnston
3,687,340 A * 8/1972 DeLaHunt ..... B67D 1/0832 222/400.7
3,712,514 A 1/1973 Leeblanc
3,720,355 A * 3/1973 Johnston ..... B67D 1/0832 137/212
3,868,049 A 2/1975 Johnston
3,905,522 A 9/1975 Johnston
(Continued)

FOREIGN PATENT DOCUMENTS

WO 2018148843 A1 8/2018

OTHER PUBLICATIONS

Notification of Transmittal of the International Search Report (Form PCT/ISA/220) and the Written Opinion of the International Searching Authority (Form PCT/ISA/237), or the Declaration , issued from the International Searching Authority to International Application No. PCT/US21/40186, dated Dec. 6, 2021, 20 pages.
(Continued)

*Primary Examiner* — Paul R Durand
*Assistant Examiner* — Michael J. Melaragno
(74) *Attorney, Agent, or Firm* — Hoffman Warnick LLC

(57) ABSTRACT

Exemplary embodiments include an apparatus that can be connected to a valve on a keg, such as a Sankey-D valve, and can be used to add gas into the keg to mix the contents, which may be including alcoholic spirts and a non-alcoholic drink mix. The apparatus has an upper structure which is coupled to a lower portion configured to mate with a keg valve. The filling apparatus may be designed to depress the ball valve and ring valve portions of the keg valve to allow for both the addition of gas and venting of gas from the keg simultaneously.

14 Claims, 8 Drawing Sheets

(56) References Cited

U.S. PATENT DOCUMENTS

| | | | | | |
|---|---|---|---|---|---|
| 4,291,821 | A * | 9/1981 | Nezworski | B67D 1/0832 | 222/153.04 |
| 4,538,746 | A * | 9/1985 | Hines | B67D 1/0848 | 222/400.7 |
| 4,706,847 | A | 11/1987 | Sankey | | |
| 4,717,048 | A | 1/1988 | Stenger | | |
| 4,860,931 | A * | 8/1989 | Hubbard | B67D 1/02 | 222/400.8 |
| 4,993,597 | A * | 2/1991 | Evers | B01F 33/452 | 222/196 |
| 5,090,440 | A * | 2/1992 | Ladouceur | B67D 1/0831 | 137/240 |
| 5,244,127 | A * | 9/1993 | Hubbard | B67D 1/0839 | 222/394 |
| 5,636,656 | A * | 6/1997 | Hubbard | B67D 1/0848 | 137/212 |
| 5,690,136 | A * | 11/1997 | Celli | B67D 1/0839 | 137/212 |
| 10,696,533 | B2 * | 6/2020 | Dalton | G05D 16/106 | |
| 11,511,986 | B2 * | 11/2022 | Ray | B67D 7/0294 | |
| 2005/0001340 | A1 | 1/2005 | Page et al. | | |
| 2006/0118574 | A1 | 6/2006 | Anderson et al. | | |
| 2010/0116356 | A1 | 5/2010 | Wauters | | |
| 2016/0100604 | A1 * | 4/2016 | Rubin | A23G 1/005 | 426/520 |
| 2016/0200561 | A1 * | 7/2016 | Dalton | B67D 1/14 | 137/505 |
| 2016/0222332 | A1 * | 8/2016 | Peirsman | C12C 5/026 | |
| 2017/0260037 | A1 * | 9/2017 | Dalton | B67D 1/0829 | |
| 2017/0336135 | A1 * | 11/2017 | Jacobsen | F25D 31/00 | |
| 2018/0280896 | A1 | 10/2018 | Perkins et al. | | |
| 2018/0303116 | A1 * | 10/2018 | Rubin | B67D 7/0216 | |
| 2018/0303117 | A1 * | 10/2018 | Rubin | B67D 3/0067 | |
| 2018/0303118 | A1 * | 10/2018 | Rubin | A23G 1/105 | |
| 2018/0303119 | A1 * | 10/2018 | Rubin | B67D 3/0012 | |
| 2022/0002132 | A1 * | 1/2022 | Ray | B67D 1/0805 | |
| 2022/0002138 | A1 * | 1/2022 | Ray | B67D 1/0831 | |
| 2022/0002141 | A1 * | 1/2022 | Ray | B67C 3/34 | |
| 2022/0055880 | A1 * | 2/2022 | Ray | C12G 3/04 | |

OTHER PUBLICATIONS

Westby, G., Negroni in Barrel, YouTube.com, Jun. 4, 2013, https://www.youtube.com/watch?v=I6PDYtZ7YoU, 1 page.

Man Skirt Brewing, Filling kegs with Hard Seltzer at Man Skirt Brewing, YouTube.com, May 10, 2020, https://www.youtube.com/watch?v=ROfH5nUvUzk, 1 page.

Invitation to Pay Additional Fees (including partial search report) for PCT/US21/59857 dated Jan. 21, 2022.

International Search Report and Written Opinion for Application No. PCT/US2021/59857, dated Mar. 24, 2022, 9 pages.

* cited by examiner

400

400

400

400

APPARATUS, SYSTEM AND METHOD FOR MIXING LIQUID IN A BEVERAGE CONTAINER

CROSS-REFERENCE TO RELATED APPLICATIONS

This application is related to U.S. application Ser. No. 17/459,734, filed Aug. 27, 2021. The contents of this application are hereby incorporated by reference in their entirety.

FIELD OF THE INVENTION

The present invention relates generally to an apparatus, system and process for mixing contents of a beverage container, and more particularly to system and method for mixing contents of a keg using an apparatus that connects to a conventional keg valve.

BACKGROUND

Bars, restaurants and other establishments that serve alcoholic beverages commonly have serving equipment that includes refrigerators, couplers, regulators, lines and taps for beer kegs. Often, a bar will offer a large selection of beers, each with its own line and customized tap. One of the most common configurations includes a Sankey-D coupler, which is a widely used coupling device in bars and restaurants for beer kegs.

Although this equipment has provided high efficiencies in serving beer, the same is not true for mixed drinks. Alcoholic beverage laws prohibit the sale of spirits in containers larger than 1.75 liters; hence there are no kegs or taps for mixed drinks. At the same time, the preparation of mixed drinks requires skill and experience to know the various constituents of the mixed drink, the relative quantities, and to consistently mix the drink in the right proportions, often in a crowded, busy environment. These factors result in significant losses, inefficiencies and decreased quality arising from inconsistent and inaccurate mixing by bartenders of different skill levels as well as the time it takes even a skilled bartender to combine all the constituents of the mixed drink.

In addition to the prohibition on selling spirits in containers larger than 1.75 liters, there is an additional challenge that has prevented the use of kegs to serve mixed drinks on tap. Kegs are generally filled with a keg filling device that uses an industrial, pressurized system to fill the keg. Conventional keg filling devices require large, high volume tanks and pressure to fill the keg through a coupling device such as a Sankey-D coupler. For example, an industrial filling equipment uses a filling Sankey with a larger internal opening to allow liquid to flow faster when filling than a normal Sankey used for dispensing. These conventional keg filling devices further typically take a large amount of space and fill the keg through a liquid dispensing tube of the coupler. Setting up such conventional keg filling devices requires large spaces and an investment in heavy equipment to install tanks. Further, the conventional keg filling devices cannot be transported without large trucks and cannot be used without large tanks and pressure. Hence, there is no easy way to fill kegs without the use of large, heavy, expensive equipment.

These and other drawbacks have greatly inhibited the efficient serving of mixed drinks at bars, restaurants and other establishments.

SUMMARY

According to an embodiment, an apparatus, system, and method is provided that enables bars, restaurants, and other establishments to serve mixed drinks and craft cocktails on draft using a standard beer keg system, such as a Sankey (or Sanke) keg and related Sankey coupler, lines, and taps. The Sankey keg may include the Sankey-D valve, for example, or other Sankey valves, such as Sankey S, A, G, U, or M type systems. Exemplary embodiments may use a Sankey-D valve as an example; however, this is meant to be non-limiting.

According to one example, a keg having a Sankey-D valve is partially filled with a non-alcoholic, liquid cocktail mix. The keg may be of any type, such as a rubber barrel, beveled barrel, half barrel, slim quarter, quarter barrel, Cornelius keg, and sixth barrel. It should be appreciated that the amount of liquid (e.g., mix and alcohol) will be adjusted based on the keg size. Since the mix is non-alcoholic, there is no prohibition on the use of a keg, such as a standard, 30-liter Sankey-D type keg. In one particular embodiment, a 30-liter keg is partially filled with 21 liters of liquid cocktail mix (e.g., margarita mix). The keg is then shipped to a bar, restaurant or other establishment that serves alcoholic drinks. A keg filling apparatus and a mixing apparatus, according to exemplary embodiments described herein, are provided to the bar, restaurant or other establishment. First, the bartender installs the keg-filling apparatus on the keg valve, degasses the keg, and pours alcohol into the keg via the keg-filling apparatus. The keg-filling apparatus allows the keg to be filled with the alcohol using only gravity, rather than a large, pressurized industrial filling system. Next, once the specified amounts and types of alcohol (e.g., 9 liters total of one or more spirits) have been poured into the keg and mixed with the cocktail mix, the keg filling apparatus is removed, the mixing apparatus is attached to the keg valve, and the contents in the keg are mixed as described herein. Once the mixing apparatus is removed, the keg is ready to be installed in the Sankey-D tap system, just like a beer keg.

According to another embodiment, the invention relates to a method for preparing mixed drinks. The method may comprise receiving a keg containing a non-alcoholic mix of liquids, wherein (a) the mix is designed to be converted to a mixed drink by addition of alcohol; (b) the quantity of the mix in the keg is predetermined to allow for the addition of a predetermined quantity of the alcohol into the keg to complete the mixed drink; and (c) the keg comprises a valve, e.g., a Sankey-D valve, designed to be connected to a coupler through which the mixed drink is dispensed. The method may also comprise using an apparatus to pour the alcohol into the keg. Lastly, the method may comprise mixing the mix with the alcohol (i.e., the keg contents) using the mixing apparatus of exemplary embodiments to complete the mixed drink in the keg; connecting the keg to a coupler; and dispensing the mixed drink through a tap connected to the coupler.

Exemplary embodiments of the invention can provide a solution that significantly reduces the time needed to make the most popular craft cocktails and mixed drinks, which, in turn, increases the number of craft cocktails and mixed drinks sold by the bar, restaurant, or other establishment. For alcoholic beverage distributors, increased throughput at bars, restaurants and other establishments results in an increase in the quantity of spirits sold. Furthermore, embodiments of the invention allow bars and restaurants that own standardized beer keg systems, such as the widely-used Sankey-D keg system, to use their existing equipment to serve craft cocktails and mixed-drinks on draft. These and other advantages will be described further in the detailed description below.

BRIEF DESCRIPTION OF THE DRAWINGS

In order to facilitate a fuller understanding of the present invention, reference is now made to the attached drawings. The drawings should not be construed as limiting the present invention, but are intended only to illustrate different aspects and embodiments of the invention.

DETAILED DESCRIPTION

Exemplary embodiments of the invention will now be described in order to illustrate various features of the invention. The embodiments described herein are not intended to be limiting as to the scope of the invention, but rather are intended to provide examples of the components, use, and operation of the invention.

Various embodiments of the invention relate to an apparatus for a container, such as a keg, for mixing liquid contained in the keg. The apparatus may be configured to be a hand-held device designed to apply gas pressure into the keg to mix the contents of the keg. According to exemplary embodiments, the contents of the keg may be a liquid mix of alcohol and non-alcoholic pre-mix. Various embodiments of the invention can overcome the disadvantages described above.

The keg may be designed to have a keg bung in which a valve (e.g., a valve having a ball valve (sometimes referred to as a beer valve) and a ring valve (sometimes referred to as a venting or CO2 valve)) is received. The keg bung may be externally threaded around its exterior circumference. The keg bung may located at the center portion on the upper surface of the keg. This valve may be referred to a Sankey-D valve. The valve may be secured to the keg by the threads surrounding the keg bung to allow for removal. The valve may include a tube that is integrally attached thereto. The tube may be referred to as a spear. The valve and spear may be removable as single piece on metal kegs. In some embodiments, the valve may be manufactured with the keg and be integral to the keg. For example, the valve (and spear) may be integral to PET kegs in a conventional arrangement.

The spear is designed to extend into the keg to allow for liquid flow in or out of the keg. For example, when liquid is added to the keg through the ball valve (e.g., beer valve), the liquid is directed downward through this tube and flows into the keg at the lower portion into the liquid volume in the keg, causing the liquid level in the keg to rise, which in turn displaces gas located above the liquid level. This gas may then exhaust through the venting valve (when it is open) and be directed out to the atmosphere outside of the keg volume. In a typical use of a keg, when liquid is being dispensed from the keg, the venting valve (e.g., CO2 valve) is opened to add pressure to the top of the liquid in the keg, so when the tap is opened at the bar, liquid can flow through the ball valve (also known as a beer valve) out of the keg.

Figure 1:
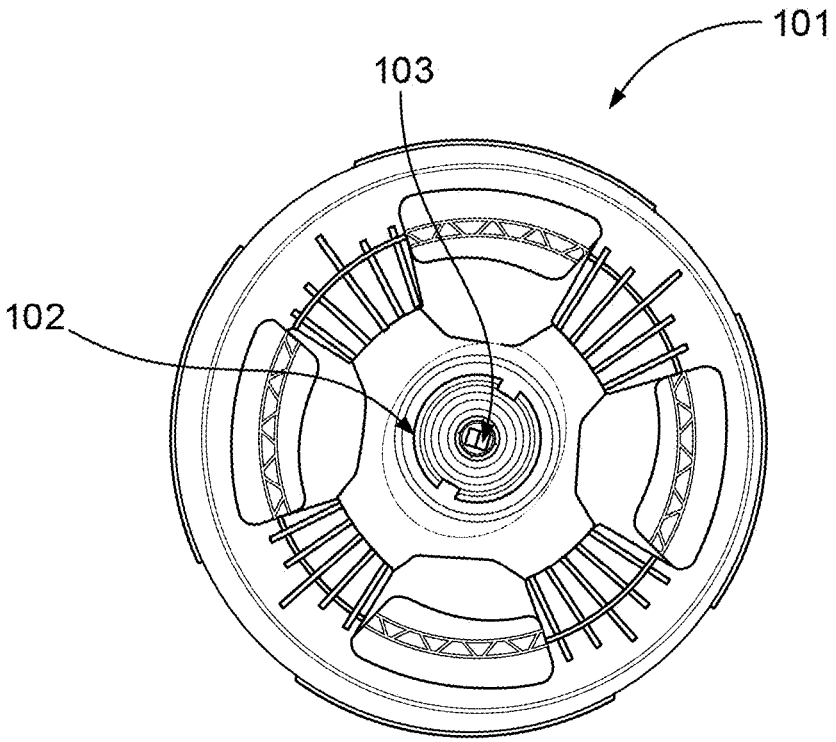
FIG. 1 illustrates a top view of a keg according to an exemplary embodiment.

FIG. 1 illustrates a top view of an example keg 101, according to an embodiment of the invention. The keg 101 shown in FIG. 1 may be a conventional steel keg or a one-time use plastic keg. In various embodiments, the key may be of any type and may be made of any material, such as a recyclable material, plastic, metal. The keg may be clear or opaque. As shown in FIG. 1, a keg bung assembly 102 is coupled to the top of the keg 101. The keg bung assembly 102 may be removably coupled to the keg 101 or may be integrated to the keg 101 (e.g., by molding, melding, or soldering). The keg bung assembly 102 may comprise a keg valve 103 (e.g., internally, the keg valve may have a ball valve and venting valve with a tube attached, i.e., a keg spear). In some embodiments, a tube may not be attached. When the apparatus disclosed herein is coupled to the keg 101 via the bung assembly 102, the keg valve 103 (ball or beer valve and ring or venting valve) can be pressed open (i.e., actuated) to allow for adding gas into the keg 101 through the ball valve to mix the contents of the keg while venting gas out of the keg 101 through the ring valve, as described herein.

The apparatus according to exemplary embodiments disclosed herein can be used to mix the contents of a keg using gas. The gas may be carbon dioxide, nitrogen, or other gas. The same gas used to pressurize a tap line system may be used.

According to exemplary embodiments, the keg may be initially be filled with a liquid pre-mix. In exemplary embodiments, the liquid pre-mix may be non-alcoholic. Liquid (e.g., alcoholic spirits) may be added to the keg using a filling device, which may be referred to as a keg spiker; by way of non-limiting example, the filing device may be one of the embodiments described in U.S. application Ser. No. 17/459,734, although other embodiments of filling devices may be used. The result liquid mix in the keg may be a cocktail or mixed drink. In order to ensure uniformity and consistency of the resulting liquid mix, prior to dispensing the keg contents to customers, the apparatus may be used to mix the liquid mix in the keg through adding gas, under pressure, through the ball valve of the keg. Excess gas may be vented through the ring valve of the keg. By adding the gas through the ball valve, the gas is directed downward through the keg spear and into the lower liquid volume of the keg. This causes turbulence in the liquid as the gas exits the spear and rises up through the liquid volume of the keg going from the bottom volume to the upper volume.

Figure 2:
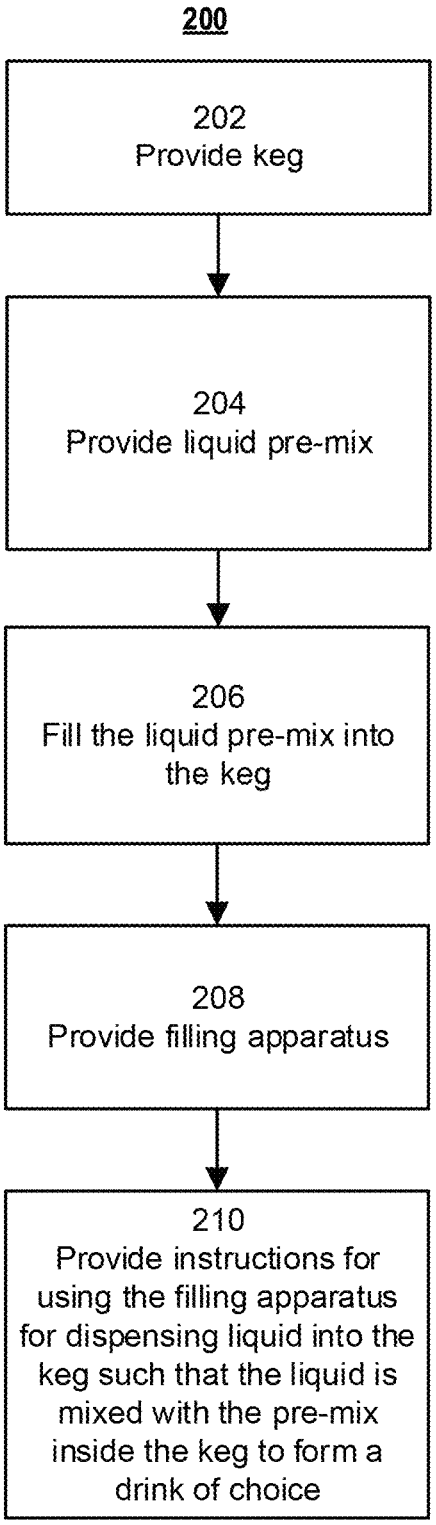
FIG. 2 is a flow chart for an example process of providing a keg partially filled with a non-alcoholic, liquid premix, according to an embodiment.

FIG. 2 illustrates a flow chart for an example process 200 for providing a keg partially filled with a non-alcoholic, liquid premix, according to one embodiment of the invention. The process 200 may be performed, for example, by a user such as a provider or manufacturer of non-alcoholic, liquid pre-mixes for making mixed drinks. The process 200 may include the following steps.

In step 202, a keg is provided. The keg may be any suitable keg, such as a keg with a standard valve that connects to a standard coupler, such as the Sankey A, D, G, M, S, or U type systems. The keg may be a one-time use keg. In an exemplary embodiment, the keg includes a Sankey-D valve which is compatible with the Sankey-D coupler that is widely used in bars, restaurants, and other establishment and venues for serving beer on draft. The keg may include a keg bung in a top portion of the keg. The keg bung may be provided with a valve located therein. The valve may have multiple parts including a ball-valve, for example, for allowing liquid to flow out of the keg but not into the keg and a venting valve (e.g., gas or CO2 valve) that allows flowing gas into to the keg to pressurize liquid out of the keg when the keg is in regular use. The venting valve may be a ring valve that surrounds the ball valve structure. For example, in normal use of the keg, when being dispensed, the venting valve (e.g., CO2 valve) is opened to add pressure to the top of the liquid in the keg, so when the tap is opened at the bar, liquid can flow through the ball valve (also known as a beer valve) out of the keg. The venting valve can also be used to release gas from the keg when adding liquid to the keg, such as, for example, in exemplary embodiments. The Sankey-D coupler, once attached to the keg, can serve two functions: 1) it opens both the venting valve and the ball or beer valve simultaneously so that pressure can be added to the top of inside of the keg, and 2) the liquid can be released from the keg through the ball valve once the tap is opened on the bar, in a restaurant, and/or at other event venues.

In step 204, a liquid pre-mix is provided. The liquid pre-mix may be any desired non-alcoholic pre-mix, including but not limited to, a liquid premix for margaritas, mojitos, mules, Paloma, Tonic, Lemonade, Cola, Seltzer, and/or Sodas. The liquid pre-mix may also comprise a single product such as Coca Cola for a rum and Coke mixed drink, or tonic water for a gin and tonic drink.

In step 206, the liquid pre-mix is filled into the keg to a first desired portion of a capacity of the keg. The liquid pre-mix may be filled into the keg in any manner using any suitable devices or systems as known in the art. The first desired portion of the capacity may be about two thirds of the capacity of the keg according to one embodiment. For example, if the capacity of the keg is about 30 liters, the first desired portion of the capacity may be about 21 liters. Other mix ratios are possible. For example, there are 12.5 liter, 19 liter, and 10 liter kegs. The mix ratio would change therefore based on the keg capacity.

In step 208, a filling apparatus and a mixing apparatus, according to exemplary embodiments described herein, are provided with the keg to engage the keg. In various embodiments, the filling apparatus and mixing apparatus described herein may be provided to an end user with the keg. The filling apparatus may be referred to as a keg spiker. The filling apparatus may be an embodiment described in U.S. application Ser. No. 17/459,734, for example. The filling apparatus may be engaged with the keg to add spirits to the keg at a location of an end user, when the user is ready. The mixing apparatus according to exemplary embodiments may be used following the filling of the keg with spirits, also at the location of the end user.

In step 210, instructions for using the filling apparatus for dispensing the liquid (e.g., alcohol) into the keg and using the mixing apparatus described herein are provided to an end user. The instructions may describe how the alcoholic liquid is mixed with the non-alcoholic pre-mix inside the keg to form a mixed drink of choice. This step may be optional.

Figure 3:
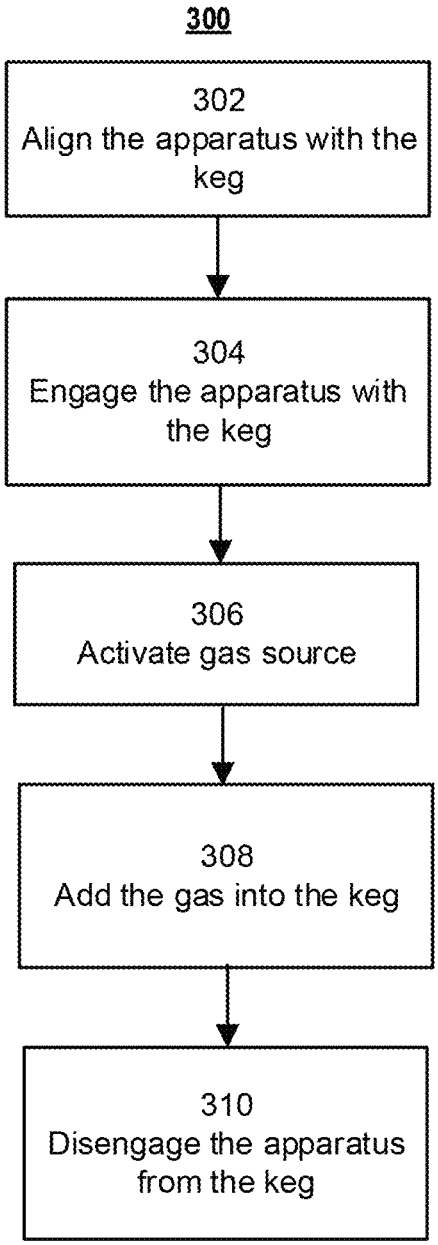
FIG. 3 is a flow chart for an example process of using an apparatus for mixing the contents of a keg containing a liquid drink mix, according to exemplary embodiments.

FIG. 3 illustrates an example of a method of using the apparatus to mix the liquid in a keg. The method 300 may include the following steps.

In step 302, the mixing apparatus is aligned with the keg bung disposed in the top portion of the keg. For example, by grasping and manipulating the mixing apparatus, the bottom terminal of the mixing apparatus is in a position ready for fitting into the keg bung to engage the keg valve.

In step 304, the mixing apparatus is engaged with the keg bung by twisting the mixing apparatus clockwise, according to one embodiment, so as to be able to simultaneously depress and open at least a portion of the keg bung valve (e.g., the ball valve and/or the ring valve) received in the keg bung and lock the mixing apparatus into place to the keg bung. Securing the mixing apparatus onto the keg bung can be achieved with the locking ring or coupling ring and the keg locking slots or teeth that engage with the ring on the device. Locking securely is required to create a tight non-leaking seal to the keg. According to exemplary embodiments, a deflector on the mixing apparatus may prevent liquid from escaping the device and impacting a user. This may allow for degassing of the keg to relieve pressure on the liquid in the keg and prevent the liquid from exiting out of the keg and through the apparatus. The deflector may direct the escaping gas and/or liquid downward, away from the user, onto the top of the keg. The gas vented may be a nitrogen gas, a carbon dioxide gas, an air gas, or combinations thereof. Further, any liquid venting up through the ball valve portion into the mixing apparatus will rise through the internal portion of the mixing apparatus and into the fitting and/or tubing. In other words, there is no external path for the liquid to impact the user (provided, the mixing apparatus is coupled to tubing prior to engagement with the keg valve; the tubing may be coupled to a gas source or may be merely coupled to the mixing apparatus fitting).

In step 306, the mixing apparatus is attached to a gas source. With the mixing apparatus engaged, a gas source may be connected. A tube or pipe may be used to couple the apparatus to a gas source. The gas source may be carbon dioxide gas, nitrogen gas, an air gas, or combination thereof. The gas source may be that used for pressurization of a tap system. Once connected to the gas source, the gas at the source may be actuated or turned on to allow for gas flow from the source to the mixing apparatus.

In step 308, the gas enters the keg through the mixing apparatus. The gas is directed through the mixing apparatus into the keg bung valve, specifically the ball valve. The gas is directed then downward though the keg spear (if present) and exits the spear into the liquid volume of the keg. The gas may then rise through the liquid volume to the surface of the liquid. The gas may exit the liquid surface and enter a volume above the liquid surface in the keg. Excess pressure caused by the gas addition may be relieve through the ring valve and exit the mixing apparatus through the venting portion. A certain volume of gas may remain in the liquid.

If no spear is present, the gas will enter the liquid directly at an upper volume of the keg.

The gas, which is under pressure, may cause turbulence in the liquid volume creating a mixing effect. The gas may be applied for 5-6 seconds according to exemplary embodiments. In some embodiments, a longer or shorter period of time may be used. A consideration in applying the gas is the amount of gas that may remain in the liquid, causing a carbonation effect. This may be desired in some drink mixes and not desired in others.

In step 310, the gas flow is turned off or secured and the mixing apparatus is disengaged from the keg. The mixing apparatus may be removed by rotating it in a counter-clockwise direction to disengage it from the locking threads of the keg bung, according to an exemplary embodiment. That is, the reverse operation of step 304 may be performed.

In some embodiments, the method 300 may include engaging the keg spear or valve assembly with a standard dispensing apparatus to dispense the drink from the keg. For example, in a bar, the keg may be set up with a standard Sankey coupler to dispense the mixed drink to customers, that is, to provide a mixed drink on draft through a standard Sankey coupler and tap, which are widely used for serving beer in bars, restaurants and other establishments.

FIGS. 4A, 4B, 4C, 4D, 4E, and 4F (collectively referred to as FIG. 4) show a device 400 according to exemplary embodiments. The device may be used to mix the contents of a keg using gas. The device may be the mixing apparatus described in the methods of FIGS. 2 and 3, above.

The device 400 may have an upper portion 402 and a lower portion 404. The upper portion 402 may have wall portion or cover 403 having an opening 406. Located at a lower portion of the upper portion 402 within the opening 406 may be a fitting or nipple 408. The fitting 408 may be configured to allow for tubing or piping to fit over it, creating a gas tight seal. In some embodiments, the exterior of the upper portion may be constructed differently and may lack the cylindrical wall portion or cover 403. That is, the fitting 408 may be exposed. The lower portion 406 may have a coupling ring 410, a probe assembly 412, and a flange 414.

The device 400 may be made of metal, plastic, polymer, wood or any other semi-rigid or rigid material which is machinable, moldable, castable or formable with physical properties such that it is rigid and able to maintain its shape and be of sufficient strength and stiffness so as to allow it to functionally perform in the manner described herein. The device 400 may be made of a combination of different materials. For example, the fitting 408 may be metal and the remainder of the device 400 may be plastic or polymer.

The coupling ring 410 may be configured to engage with the keg valve structure. The coupling ring 410 may be engaged by positioning it onto the keg, pushed down, and twisting until the coupling ring 410 fully engaged in order to lock the device 400 in place and create a seal with the keg valve. The flange 414 may provide a cover for the engagement portion with the keg valve. The coupling ring 410 may have two cut-outs 422 that are configured to engage with two teeth located on the valve structure of the keg. This locks the device 400 into place. After the teeth are positioned into each cut-out 422, a ramped portion may allow for locking engagement of the coupling ring 410 with the keg valve structure when twisted or turned into place.

The probe assembly or probe 412 may include a portion 416 to engage with and depress the ball valve on the keg. The portion 416 may consist of two hemispherical structures as shown that surround outlet 420. The outlet 420 may by the terminus of a pathway that extends upward from to the lower extremity the device to the top of the fitting 408, creating a flow path from fitting 408 to the bottom of the device 400. Ridged portion 418 may engage with and depress the ring valve on the keg. Passageways or cut-outs 424 may provide a pathway for gas venting from the keg during use of the device 400. As can be seen, there may be multiple pathways 424, allowing for multiple gas venting pathways, to increase venting from the keg. The flange portion 414 may direct any gas venting downward onto the upper surface of the keg, away from any user of the device. Further, as the device is engaged onto the keg valve, the ball valve may be engaged first (i.e., prior to the engagement of the ring valve). In doing so, liquid may exit the keg valve as it is opened (since the liquid in the keg may be under pressure). This liquid may spray or stream out at the keg valve area around the probe 412 prior to the device being fully engaged with the keg valve such that the ball valve is fully open. The flange portion 414 may prevent this liquid from spraying upward and/or outward and impacting a user of the device. Instead, any liquid spray may be directed downward by the flange onto the keg upper surface, from which it may run-off or be soaked up by an appropriate absorbent material by a user. In addition, there may be liquid mixed with the gas in the gas venting pathways and this flange may perform the same function in directing such liquid downward onto the keg. Some embodiments may lack the flange portion 414.

Figure 4A:
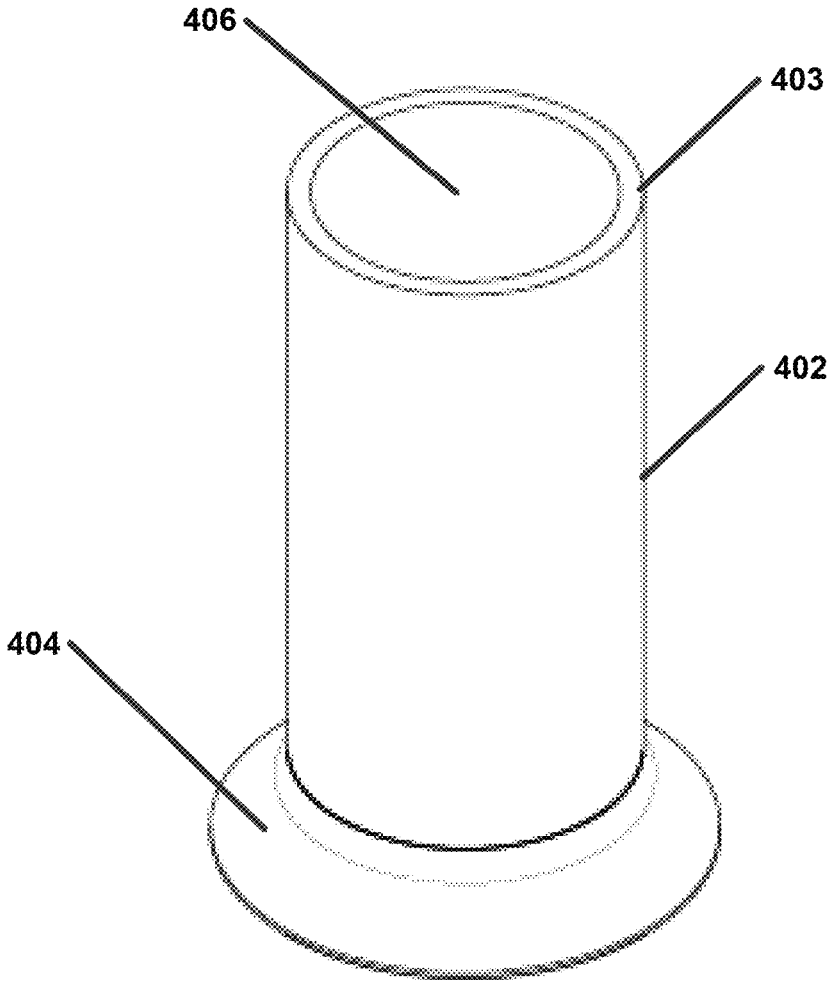
FIG. 4A illustrates a top perspective view of a mixing apparatus, according to an exemplary embodiment.
Figure 4B:
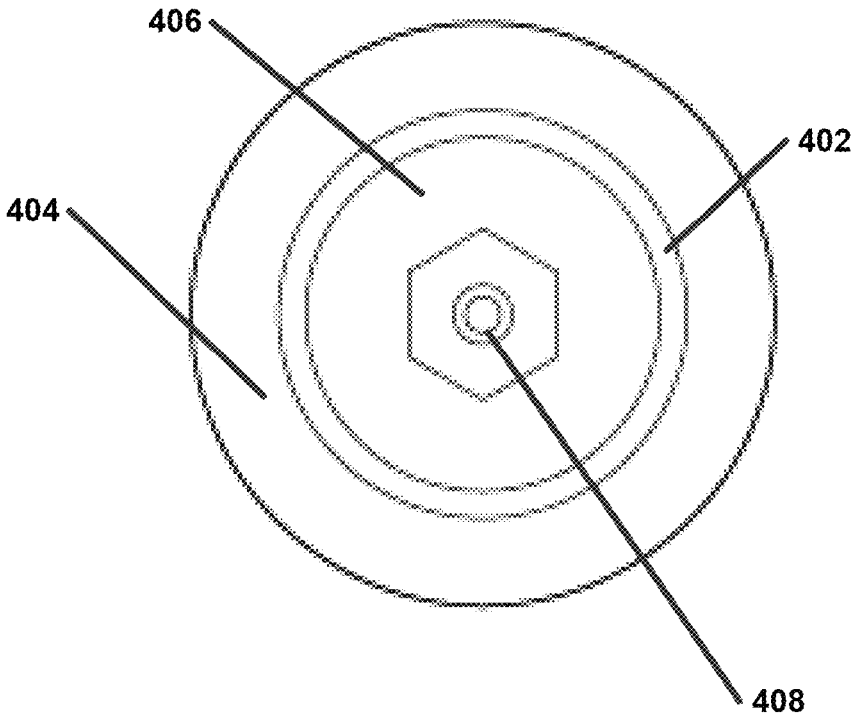
FIG. 4B illustrates a top view of the mixing apparatus, according to an exemplary embodiment.
Figure 4C:
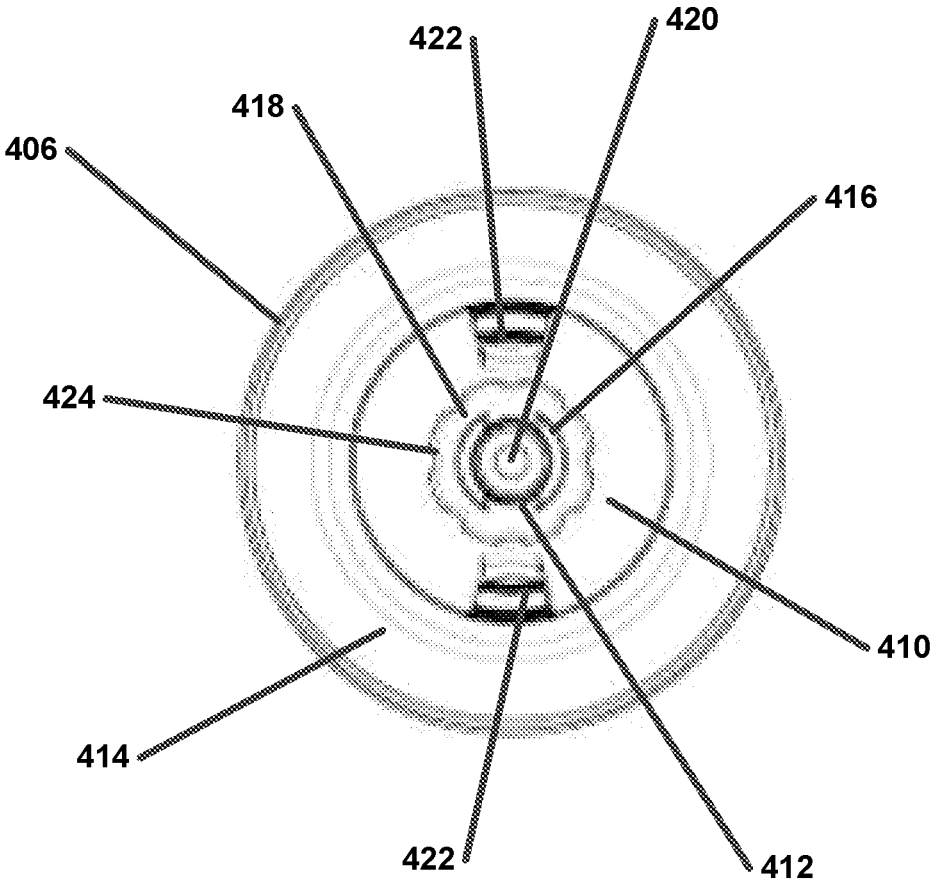
FIG. 4C illustrates a bottom view of the mixing apparatus, according to an exemplary embodiment.
Figure 4D:
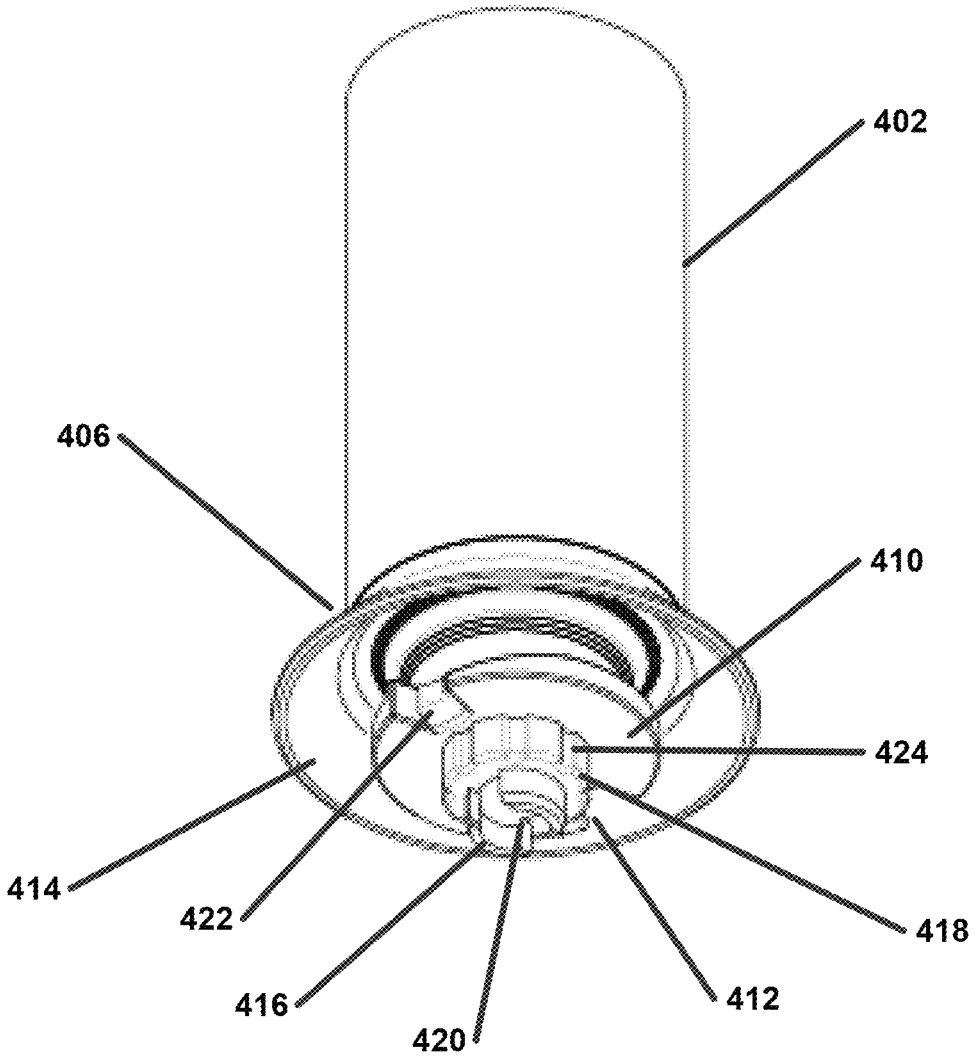
FIG. 4D illustrates a bottom perspective view of the mixing apparatus, according to an exemplary embodiment.
Figure 4E:
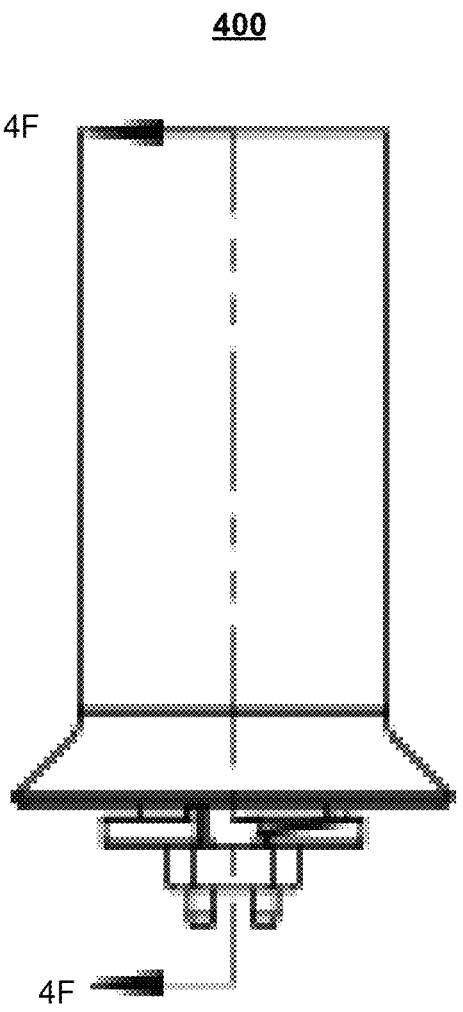
FIG. 4E depicts a side view of the mixing apparatus, according to an exemplary embodiment.
Figure 4F:
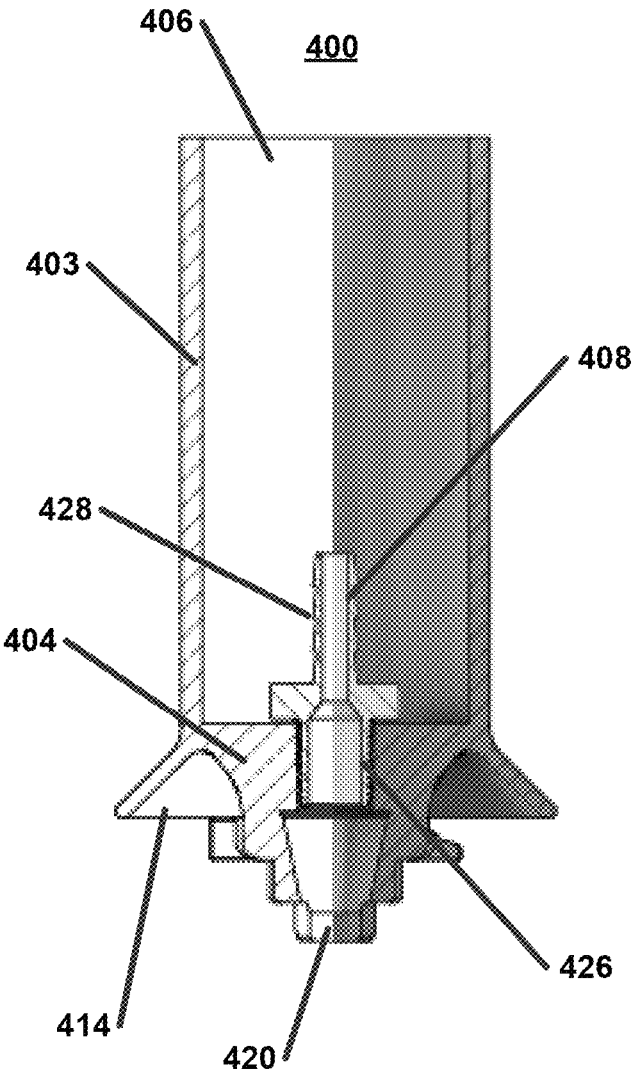
FIG. 4F depicts a cross-section view of the mixing apparatus along the line A-A of FIG. 4E, according to an exemplary embodiment.

FIG. 4F depicts the internal structure of the device 400. As can be seen, the pathway extends from 420 through the upper portion of fitting 408. The fitting 408 may be screwed into or otherwise secured and mated with the lower portion 404 at 426. The fitting 408 may have ridges, raised edges, or barbs to promote a secure seal with tubing or piping placed onto the fitting 408.

When the device 400 is engaged with the keg, according to exemplary embodiments, the probe assembly 412 may engage with the keg valve structure, as described herein. The probe assembly may depress the ball valve and the ring valve of the keg valve, creating pathways for gas into and out of the keg. According to exemplary embodiments, a gas pathway into the keg is through the ball valve and a gas pathway out of the keg is through the ring valve. Because the keg contents are liquid and may be under pressure, the liquid may vent through the ball valve portion and up into the device 400 when the device is engaged initially; the flange 414 may deflect this spray. Simultaneously to any liquid venting, gas in the keg may vent through the keg ring valve and through the probe assembly 412 structure (i.e., pathways 424), lowering the pressure in the keg. Once the device 400 is engaged and initial pressure is relieve, gas may be admitted to the keg through coupling a tube or piping to the fitting 408 and actuating gas flow. The gas may flow through the fitting 408 and exit the device 400 at opening 420 into the keg. Excess gas pressure in the keg may be relieved through the ring valve and the probe assembly structure (i.e., pathways 424). Once the gas has been admitted to the keg in the desired amount or for the desired amount of time to promote mixing of the keg contents, gas flow may be shut off, and the device 400 removed from the keg.

Various embodiments of the invention provide a number of advantages. For example, the apparatus is easy to use, requiring little training and no other equipment or device. One person is able to use the apparatus effectively and easily, e.g., attach it to a keg and apply gas into the keg to mix the contents. It is small enough to be transported easily and stored in a small space. It requires very little expertise to use effectively. For example, the apparatus can be easily used by a bartender or restaurant worker to mix the contents of a keg after adding alcohol to the keg (which contained a non-alcoholic pre-mix) to create the desired cocktail or mixed drink enabling a bar or restaurant to efficiently make and serve mixed drinks of consistently high quality on draft using standard, widely deployed coupling and serving equipment, such as the Sankey-D coupler and taps.

Although embodiments of the present invention have been described herein in the context of a particular implementation in a particular environment for a particular purpose, those skilled in the art will recognize that its usefulness is not limited thereto and that the embodiments of the present invention can be beneficially implemented in other related environments for similar purposes. The invention should therefore not be limited by the above described embodiments, method, and examples, but by all embodiments within the scope and spirit of the invention as claimed.

Although some embodiments of the invention are illustrated and described herein as embodied in a hand-held pressure release and gas directing apparatus, it is not intended to be limited to the details shown because various modifications and structural changes may be made therein without departing from the spirit of the invention and within the scope and range of equivalents of the attributes described. Additionally, well-known elements of exemplary embodiments of the invention are not described in detail or omitted so as not to obscure the relevant details of the invention.

Further, it is to be understood that the terminology used herein is for the purpose of describing particular embodiments only and is not intended to be limiting. The terms "a" or "an" as used herein, are defined as one or more than one. The term "plurality" as used herein, is defined as two or more than two. The term "another" as used herein, is defined as at least a second or more. The terms "including" and/or "having," as used herein, are defined as comprising (i.e., open language). The term "coupled," as used herein, is defined as connected, although not necessarily directly, and not necessarily mechanically. The term "providing" is defined herein in its broadest sense, e.g., bringing/coming into physical existence, making available, and/or supplying to someone or something, in whole or in multiple parts at once or over a period of time. Also, for purposes of description herein, the terms "upper," "lower," "left," "rear," "right," "front," "vertical," "horizontal," and derivatives thereof relate to the invention as oriented in the figures and is not to be construed as limiting any feature to be a particular orientation, as said orientation may be changed based on the user's perspective of the device. The term "funnel axis" should be understood to mean in a direction corresponding to the funnel channel.

In the invention, various embodiments have been described with references to the accompanying drawings. It may, however, be evident that various modifications and changes may be made thereto, and additional embodiments may be implemented, without departing from the broader scope of the invention as set forth in the claims that follow. The invention and drawings are accordingly to be regarded in an illustrative rather than restrictive sense.

The invention is not to be limited in terms of the particular embodiments described herein, which are intended as illustrations of various aspects. Many modifications and variations can be made without departing from its spirit and scope. Functionally equivalent systems, processes and apparatuses within the scope of the invention, in addition to those enumerated herein, may be apparent from the representative descriptions herein. Such modifications and variations are intended to fall within the scope of the appended claims. The invention is to be limited only by the terms of the appended claims, along with the full scope of equivalents to which such representative claims are entitled.

What is claimed is:

1. An apparatus for mixing liquid in a container, the container comprising a valve that seals the container and a locking recess to receive the apparatus, the apparatus comprising:

an upper portion comprising a fitting for connecting to a line fluidly coupled to a gas source;

a lower portion, extending from the upper portion and comprising:

a locking ring configured to mate with the container and lock the apparatus into place; and a probe that engages with the valve of the container to open the valve sealing the container, wherein the valve of the container comprises a Sankey-D valve and wherein the probe is configured to engage the Sankey-D valve.

2. The apparatus of claim 1, wherein the container is a keg and the valve sealing the container comprises a ball valve and a ring valve.

3. The apparatus of claim 2, wherein the probe engages both the ball valve and the ring valve.

4. The apparatus of claim 1, wherein the fitting comprises a barbed fitting.

5. The apparatus of claim 1, wherein the gas is one of carbon dioxide or nitrogen.

6. A method of distributing mixed drinks comprising:

providing a keg containing a non-alcoholic mix of liquids, wherein the mix is designed to be converted to a mixed drink by addition of alcohol; the quantity of mix in the keg is predetermined to allow for the addition of a predetermined quantity of the alcohol into the keg to complete the mixed drink; and the keg comprises a valve that is designed to connect to a coupler used to dispense beverages from the keg, wherein the valve comprises a Sankey-D valve; and providing an apparatus to engage the keg and for mixing the contents of the keg, wherein the apparatus includes an upper portion connected a lower portion, the lower portion comprising a probe to displace one or more portions of the valve, a locking ring to lock the apparatus onto the keg and a flange to cover the locking ring and probe, and the upper portion comprising a gas line coupling, that, once coupled to a gas line, creates a flow path for gas through apparatus and into the keg through at least a portion of the valve.

7. The method of claim 6, further comprising providing instructions to the end user regarding the process for installing the apparatus on the keg.

8. The method of claim 7, further comprising providing instructions to an end user regarding the amounts and types of alcohol to be added to the mix in the keg.

9. The method of claim 6, wherein the gas line is coupled to a gas source comprising one of carbon dioxide or nitrogen.

10. A method of preparing mixed drinks comprising:

receiving a keg containing a non-alcoholic mix of liquids, wherein (a) the mix is designed to be converted to a mixed drink by addition of alcohol; (b) the quantity of the mix in the keg is predetermined to allow for the addition of a predetermined quantity of the alcohol into the keg to complete the mixed drink; and (c) the keg comprises a valve designed to be connected to a coupler through which the mixed drink is dispensed; and using a filling apparatus to pour the alcohol into the keg;

using a mixing apparatus to add gas to the keg to mix the contents, wherein the mixing apparatus includes an upper portion, comprising a gas line coupling, connected to a lower portion, the lower portion comprising a locking ring to lock the apparatus onto the keg, a probe to displace one or more portions of the valve, and a flange to cover the locking ring and probe, wherein the keg comprises a Sankey-D valve that comprises a ball valve and a ring valve and the mixing apparatus is configured to engage with and actuate the ball valve and the ring valve when locked onto the keg.

11. The method of claim 10, wherein using the mixing apparatus comprises applying gas to the keg for 5-6 seconds.

12. A system for distributing mixed drinks comprising:

a keg containing a non-alcoholic mix of liquids, wherein (a) the mix is designed to be converted to a mixed drink by addition of alcohol; (b) the quantity of the mix in the keg is predetermined to allow for the addition of a predetermined quantity of the alcohol into the keg to complete the mixed drink; and (c) the keg comprises a valve designed to be connected to a coupler through which the mixed drink is dispensed, wherein the valve of the keg comprises a Sankey-D valve;

a filling apparatus for pouring the alcohol into the keg;

a mixing apparatus for mixing the contents of the keg after the alcohol is poured into the keg, the mixing apparatus comprising an upper portion, comprising a gas line coupling, connected to a lower portion, the lower portion comprising a locking ring to lock the apparatus onto the keg, a probe to displace a first and second portion of the valve, and a flange to cover the locking ring, the mixing apparatus being configured to allow gas to escape from the keg through the second portion of the valve and gas to enter the keg through the first portion of the valve.

13. The system of claim 12, wherein the first portion of the valve comprises a ball valve and the second portion comprises a ring valve.

14. An apparatus for filling a keg with liquid, the keg comprising a valve that seals the keg and a locking recess to receive the apparatus, the apparatus comprising:

an upper portion comprising a gas line coupling;

a lower portion, fixedly joined to the upper hollow body, comprising a coupling ring, a flange, and a probe assembly;

the coupling ring configured to engage with the locking recess on the keg;

the probe assembly configured to engage with the valve when the coupling ring is engaged, wherein the valve of the keg includes a Sankey-D valve, and the probe assembly is configured to engage the Sankey-D valve and comprises a first portion to depress a ball valve portion of the Sankey-D valve and a second portion to depress a ring valve portion of the Sankey-D valve, wherein depressing the ball valve allows for gas flow from the apparatus into the container and wherein depressing the ring valve allows for venting of gas from the keg, the second portion comprising a plurality of gas venting pathways to the atmosphere; and the flange covering the coupling ring and the probe assembly, the flange being configured to direct liquid and gas vented during engagement of the apparatus onto the keg.

* * * * *